United States Patent [19]

Gunneman

[11] 4,381,021

[45] Apr. 26, 1983

[54] HANDTOOL FOR THREADING YARNS IN YARN-PROCESSING APPARATUS

[75] Inventor: Paul Gunneman, Mierlo, Netherlands

[73] Assignee: Ruti-Te Strake B.V., Deurne, Netherlands

[21] Appl. No.: 237,643

[22] Filed: Feb. 24, 1981

[30] Foreign Application Priority Data

Feb. 26, 1980 [NL] Netherlands ..... 8001162

[51] Int. Cl.[3] ..... D03J 3/00; G03B 1/56

[52] U.S. Cl. ..... 139/380; 139/1 R; 139/382; 139/435; 226/91; 226/97

[58] Field of Search ..... 139/380, 381, 382, 1 R, 139/435; 112/80, 79 PR; 81/3 R; 226/97, 91

[56] References Cited

U.S. PATENT DOCUMENTS

| | | | |
|---|---|---|---|
| 1,063,133 | 5/1913 | Miller | 139/382 |
| 3,367,371 | 2/1968 | Van Mullerom | 139/435 |
| 3,819,099 | 6/1974 | Bierenfeld | 226/91 |
| 4,114,790 | 9/1978 | Sighieri | 226/97 X |

FOREIGN PATENT DOCUMENTS

| | | | |
|---|---|---|---|
| 519825 | 2/1921 | France | 139/381 |
| 522649 | 4/1921 | France | 139/380 |
| 571679 | 1/1958 | Italy | 226/97 |
| 9337 | of 1911 | United Kingdom | 139/382 |

*Primary Examiner*—James Kee Chi

*Attorney, Agent, or Firm*—C. O. Marshall, Jr.

[57] ABSTRACT

A handtool (1,2) for threading e.g. a weft yarn in a pneumatic weaving machine has a conduit (8,9) issuing therefrom, the free end of which constituting a blowing nozzle (9). Adjacent to the nozzle aperture a guiding surface (3) for the yarn is provided. This tool may be used in difficultly accessible points of the yarn path through the machine. The yarn is presented to the guiding surface (3) of the tool whereafter it is carried along by the air jet of the blowing nozzle (9). In one embodiment the tool has a thread guiding eye (4) with a lateral release slot (5).

6 Claims, 5 Drawing Figures

HANDTOOL FOR THREADING YARNS IN YARN-PROCESSING APPARATUS

BACKGROUND OF THE INVENTION

The invention relates to a handtool for threading yarns in yarn processing apparatus.

For threading yarns in yarn processing apparatus, such as a pneumatic weaving machine, generally threading needles are used. Such threading needles are inserted at a certain position of the yarn course in an upstream direction through one or more guide apertures or channels determining the path of the yarn through the machine and are retracted in the yarn transport direction after connection with the head end of the yarn to be threaded. The yarn course through the yarn processing apparatus is often erratic in that only predetermined stretches of said yarn course may be covered by a threading needle so that threading in the remainder of the yarn course has to be carried out through the thumb and forefinger.

Further a threading method for pneumatic weaving machines is known from the Dutch patent application 6610174 (=Swiss Pat. No. 462.061) whereby part of the weft yarn path is bridged by a tube in which an air flow moving in the yarn transport direction is generated.

Threading the yarn then takes place by presenting the head end of the yarn to the upstream end of the tube and by further having the air flow carry along the yarn in the yarn transport direction. However, as for threading needles it also applies for this threading method that the application thereof is generally limited to portions of the total yarn path.

SUMMARY OF THE INVENTION

The invention aims at providing a handtool by means of which the threading of yarns may also be carried out in difficultly accessible stretches of the yarn course in a quick and effective manner.

The handtool according to the invention is characterized by a handle with a conduit issuing therefrom and connectable to a pressurized fluid source, the free end of the conduit constituting a blowing nozzle and wherein a supporting or guiding surface respectively has been formed for the yarn to be threaded adjacent the nozzle aperture.

When the pressurized fluid supply has been switched on a pressurized fluid jet, e.g. an air jet, is generated through the nozzle end of the pressurized fluid conduit. For threading the tool is kept, e.g. by the right hand, in such a position that this air jet is being aligned along the path of the yarn course, that is upstream of one or more guide channels or guide walls determining that yarn course. Therein the yarn to be threaded is presented by the left hand to the supporting or guiding surface respectively, so that it enters into the influence of the air jet and is carried along thereby. In this manner the yarn is transported through the guide channels or along the guide walls respectively, provided downstream of the tool, and is threaded thereby.

In a first practical embodiment a thread guiding eye, having a lateral release slot, is used as the guiding surface. When the pressurized fluid supply is switched on the blowing nozzle will generate a pressurized fluid flow passing through said thread guiding eye, which flow carries along the head of the yarn to be threaded, which head is presented to the inlet end of the eye.

After the threading the tool may be released from the yarn through the lateral release slot.

Preferably the thread guiding eye constitutes the discharge end of a funnelshaped screen, the pressurized fluid conduit extending along the interior of the funnel wall in the direction of the discharge end, the funnel wall being provided with a lateral slot which merges with the release slot of the thread guiding eye. In this embodiment the head of the yarn and the secondary air, enclosing said yarn, are guided by the funnelshaped screen towards the thread guiding eye. The funnelshaped screen thereby enlarges the area from which the head of the yarn will be sucked with certainty into the thread guiding eye.

In a second practical embodiment the blowing nozzle is constituted by a substantially cylindrical end piece of the pressurized fluid conduit, said end piece being closed at its head end, the nozzle aperture being constituted by an aperture in the side wall of this end piece, while an element projecting from the said side wall substantially parallel to the axis of the nozzle aperture serves as the supporting or guiding surface respectively for the yarn to be threaded. The projecting element may be simply constituted by a pin. When using the tool according to the invention in this embodiment the end portion of the yarn to be threaded is simply laid on the pinshaped projection. If then the pressurized air supply is switched on the yarn is carried along by the air jet in the threading direction while the yarn slides on the pinshaped projection. The pinshaped projection may simultaneously serve as positioning means. If for example the yarn must be threaded through a thread guiding eye or through a weft transporting device, the tool may simply be "hooked" with the pinshaped projection in the thread guiding eye or in the inlet aperture of the weft transporting device respectively, so that the nozzle aperture becomes aligned relative to the thread guiding eye or the inlet aperture respectively.

A modification of this second embodiment is characterized thereby that the projecting element is constituted by a sleeve extending around the nozzle aperture, the free end edge of this sleeve having an incision in an axial plane in order to form a seat for the yarn to be threaded. When using the tool in this embodiment the yarn to be threaded is simply laid in the shape of a loop in the incision of the projecting sleeve and thereby in the path of the air jet.

DESCRIPTION OF THE PREFERRED EMBODIMENTS

Figure 5:
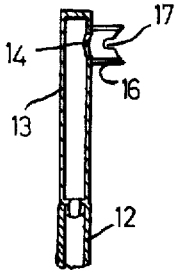
FIG. 4 shows the tool according to FIG. 3 in the operative position at the start of the threading process and FIG. 5 shows a longitudinal section of a modification of the embodiment according to FIGS. 3 and 4.

The drawing shows the handle 1. A supporting arm 2 is mounted to this handle, said arm extending substantially in the projection of the circumferential surface of the handle. A funnelshaped guiding screen 3 is secured to the free end of the supporting arm 2, the substantially cylindrical discharge end 4 thereof constituting a thread guiding eye for the yarn to be threaded.

The axis of the funnelshaped screen 3 and of the thread guiding eye or the discharge end 4 respectively are perpendicular to the axis of the handle 1.

Reference number 5 shows a lateral slot through which the yarn may issue outwardly from the space limited by the guiding screen and the guiding eye respectively.

The handle 1 comprises a central channel 6 which may be connected at 7 to a source for pressurized fluid e.g. pressurized air. The channel 6 is continued at the end remote from the connection end 7 as a conduit 8 which is laterally supported by the arm 2 and merges into a narrower conduit 9, the cross-section of which being a fraction of the aperture of the thread guiding eye 4 and which is guided along the interior of the funnel wall to adjacent the entrance end of the thread guiding eye 4.

Reference number 10 indicates a valve which normally, under the influence of a spring 11, is in its closed position, in which the pressurized air supply through the conduit 6 is interrupted. When the valve 10 is pressed against the spring pressure, it arrives in its open position and when the tool is connected to a pressurized air source a fine air jet is delivered. This air jet sucks secondary air from the atmosphere, which secondary air mixes with the air jet into an air flow moving through the thread guiding eye 4. If now in the vicinity of the funnelshaped guiding screen 3 the head is presented of a thread to be threaded, this thread will be carried along together with the secondary air and will be transported through a certain distance along the axis of the thread guiding eye 4. Experiments with the tool according to the invention have shown that it is possible in this manner to move with certitude e.g. a weft thread along a relatively large distance between two surfaces, spaced at relatively small distance, such as the facing effective surfaces of a yarn clamp.

Figure 4:
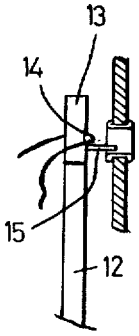
Figure 3:
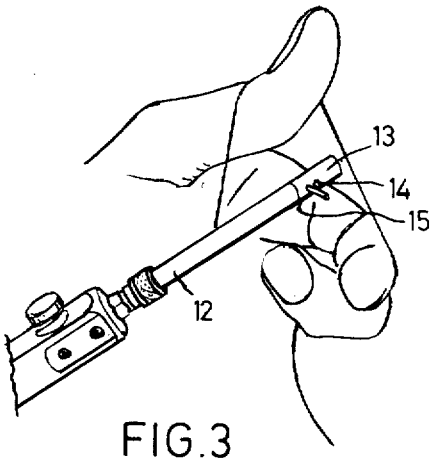
FIG. 3 shows a perspective view of the tool according to the invention in a second embodiment.
Figure 1:
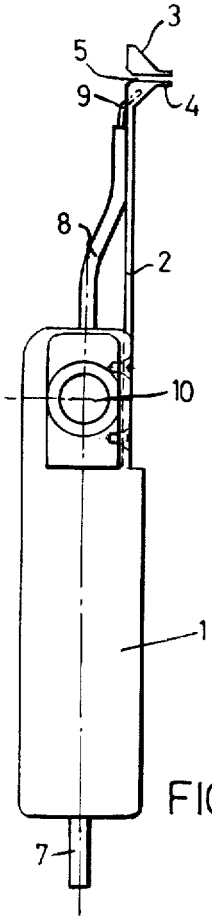
FIG. 1 shows a plan view of the tool according to the invention in a first embodiment.
Figure 2:
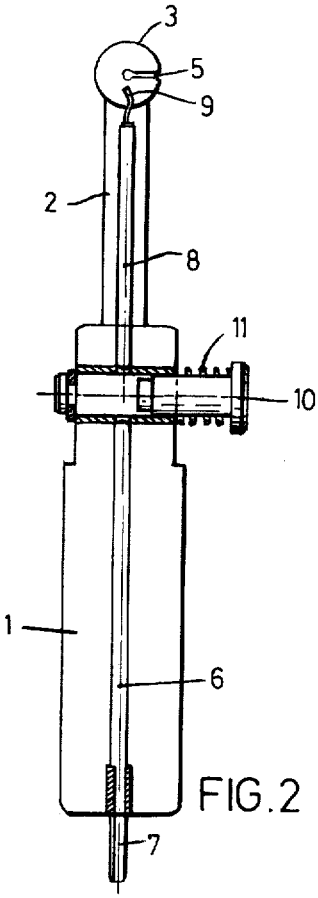
FIG. 2 shows a longitudinal section through the tool according to FIG. 1, namely along a cross-sectional plane perpendicular to the axis of the guiding eye.

In the embodiment according to FIGS. 3 and 4 the supporting arm of the embodiment according to FIGS. 1 and 2 has been omitted, whereas the conduits 8 and 9 of the first embodiment have been replaced by a flexible conduit 12, e.g. manufactured from plastic material. This conduit ends in a substantially cylindrical end piece 13 which is closed at its head end. In the cylindrical side wall of this end piece an aperture 14 has been provided, which constitutes the nozzle aperture. Reference number 15 indicates a pinshaped projection secured to the cylindrical side wall of the end piece 13, said projection being adjacent the opening edge of the aperture 14 and extending substantially parallel to the axis of this aperture. This pinshaped projection 15 constitutes a laying-on support when preparing the threading process, as well as the guide for the yarn during the starting phase of the threading process. FIG. 5 shows in which manner the yarn to be threaded is laid loopshaped over the end piece 13 on the pinshaped projection 15, whereas FIG. 4 shows the tool in its position during the threading process.

An advantage of the second embodiment is the simplicity and the robustness of the construction.

In the modification according to FIG. 5 the pinshaped projection 15 of the embodiment according to FIGS. 3 and 4 has been replaced by a sleeveshaped projection 16 extending around the opening edge of the nozzle aperture 14. An incision 17 has been provided in the end edge of the sleeve shaped projection 16. When preparing the threading process the yarn to be threaded is guided loopshaped into this incision and thereby into the path of the air jet to be produced by the end piece 13.

I claim:

1. Handtool for threading a yarn into a difficult-to-reach path in a yarn processing apparatus, comprising a handle, a conduit which has an inlet for connection to a source of pressurized fluid and which extends from said handle and has a discharge orifice adjacent to its free end, a yarn support arranged to hold the leading end of the yarn in position to be entrained by a jet of fluid discharged from said orifice, and a valve for shutting off the flow of pressurized fluid through said conduit, whereby said conduit serves as a probe for placing the leading end of the yarn in position to be inserted into said path by a jet of fluid discharged through said orifice.

2. Handtool according to claim 1 wherein the yarn support comprises a thread-guiding eye having a lateral release slot.

3. Handtool according to claim 1 wherein the yarn support comprises a funnel having a thread-guiding eye forming its discharge end, and having a lateral slot, said eye having a lateral release slot merging with the lateral slot of the funnel, and the discharge orifice of the conduit being directed along the interior of the funnel toward said eye.

4. Handtool according to claim 1 wherein the free end of the conduit is closed but has a lateral discharge orifice, and the yarn support is in the form of an element projecting laterally from the conduit adjacent to said orifice.

5. Handtool according to claim 4 wherein the projecting element is in the form of a pin.

6. Handtool according to claim 4 wherein the projecting element is in the form of a sleeve which projects around the orifice and is notched at its outer end to receive the leading end of the yarn.

* * * * *